United States Patent [19]

Herder

[11] 4,252,300

[45] Feb. 24, 1981

[54] BURNER CONTROL SYSTEM

[75] Inventor: Gary A. Herder, Kalamazoo, Mich.

[73] Assignee: Prab Conveyors, Inc., Kalamazoo, Mich.

[21] Appl. No.: 122,511

[22] Filed: Feb. 19, 1980

Related U.S. Application Data

[63] Continuation of Ser. No. 885,759, Mar. 13, 1978, abandoned.

[51] Int. Cl.[3] ..... C21C 5/38

[52] U.S. Cl. ..... 266/144; 266/901; 432/72; 110/212; 431/48; 431/60; 236/1 EB

[58] Field of Search ..... 432/72; 110/190, 212, 110/213, 210; 236/1 EB, 1 A; 34/44, 56, 134; 266/901, 144; 431/42, 48, 60, 24, 33

[56] References Cited

U.S. PATENT DOCUMENTS

| | | | |
|---|---|---|---|
| 2,183,855 | 12/1939 | Mansky | 431/48 |
| 2,479,797 | 8/1949 | Wasser | 431/48 |
| 3,049,168 | 8/1962 | Litwinoff | 431/60 |
| 3,135,314 | 6/1964 | Brunner | 431/60 |
| 3,138,194 | 6/1964 | Jackson et al. | 236/1 EB |
| 3,308,869 | 3/1967 | Livingston | 236/1 EB |
| 3,619,907 | 11/1971 | Kallas | 34/44 |
| 3,619,908 | 11/1971 | Kallas | 34/44 |
| 3,684,423 | 8/1972 | Bryant | 431/24 |
| 3,767,179 | 10/1973 | Larson | 266/901 |

*Primary Examiner*—Henry C. Yuen

*Attorney, Agent, or Firm*—Dressler, Goldsmith, Shore, Sutker & Milnamow, Ltd.

[57] ABSTRACT

A control system for multiple burners or heaters in an afterburner section of a metal scrap dryer is provided. The control system provides for cascade and sequential control including selective and sequential ignition as well as selective and sequential deenergization of the burners or heaters.

5 Claims, 4 Drawing Figures

OIL
GAS
71
120-2
120-6
88
142-1-2
142-2-2
142-3-2
138-1-3
76-1
138-2-3
76-2
138-3-3
76-3
138-1-4
102-1
138-2-4
102-2
138-3-4
102-3
158
90-1
92
94
156
150
148-2
152
148-3
156-2
120-3
THERMOCOUPLE
PROPORTIONAL CONTROLLER
AMMETER
PROP RELAY #1
138-1-4
MOTORIZED FUEL VALVE #1
74
PROPORT RELAY #2
138-2-4
138-3-4
MOTORIZED FUEL VALVE #2
80
PROPORT RELAY #3
SECONDARY AIR DAMPER MOTOR
37
38
39
40
41
42
43
44
45
46
47
48
49
50
51
52
53
54
55
56
57
58
59
60
61
62
63
64
65
66
67
68
69
70
71
72
73
74
75
76
77
78
79
80

BURNER CONTROL SYSTEM

This is a continuation of application Ser. No. 885,759, filed Mar. 13, 1978, now abandoned.

BACKGROUND OF THE INVENTION

The present invention relates to systems and methods for treatment of metal scrap contaminated with combustible substances, and more particularly to apparatus and method for efficiently and automatically insuring complete combustion of contaminants removed from the scrap.

The reclamation of metal scrap by melting requires some preliminary treatment for removal of contaminants on the scrap, such as oil, grease and other similar organic contaminants. Metal scrap should be understood to include swarf, turnings, chips and other materials generated during metal wording operations with metals such as cast iron, aluminum, aluminum alloys, magnesium, and magnesium alloys and others.

The preparatory treatment is usually referred to in the art as drying and is often conveniently carried out in a drying apparatus, one embodiment of which includes an elongated rotating drum slightly sloping with respect to the horizontal. Examples of scrap dryers are shown in U.S. Pat. Nos. 3,619,907; 3,619,908; and 3,767,179.

Typically, scrap is introduced into such a rotating drum at one end, for example, a relatively higher input end, and upon rotation of the drum the scrap travels downwardly towards the lower or output end. During this travel the scrap contacts hot gases which are generated by a burner situated at one end of the drum. The gases are sufficiently hot to effect evaporation of such contaminants and to bring about at least a partial combustion thereof. If a sufficient amount of combustible contaminants are present, a self-supporting flame can be maintained within the drying mechanism.

In order to provide complete combustion of the waste material, exhaust gases which typically contain combustible material are directed into an afterburner device. The temperature in the afterburner is desirably controlled to insure a temperature high enough to complete all combustion without maintaining an excessively high temperature. Typically, the temperature in the afterburner is controlled by regulating one or more burners or heaters utilized to heat the afterburner to maintain the desired temperature. A secondary supply of air may be provided to insure adequate oxygen for complete combustion.

The temperature in the afterburner is not only affected by burner operation, but also by the temperature of the exhaust from the dryer and by the existence or absence of unburned combustibles in this exhaust.

Thus, when the exhaust contains smaller amounts of unburned combustibles, the burners must be selectively energized to maintain the desired afterburner temperature. When the exhaust contains unburned combustible wastes, the combustion of these wastes in the afterburner may be sufficient to maintain temperature in the afterburner without any meaningful additional heat supplied by heaters or burners.

In addition, in order to prevent overheating in the afterburner, the secondary external air supply is also controllable to supply additional air to lower the temperature in the afterburner, if necessary.

Typically, in order to provide sufficient capacity for maintaining desired temperature in the absence of unburned combustibles, it is usually necessary to utilize a plurality of afterburner heaters. In practice, the burners utilized in the afterburner section of the dryer typically have a maximum heat producing ratio of 3:1 between the maximum and minimum settings. Thus, even when the temperature in the afterburner requires no additional heat input, the burners are producing heat and as a result there is a requirement for additional secondary air in order to prevent the temperature in the afterburner from exceeding the maximum limits.

It can be readily appreciated that this type of operation in which the minimum heat output is ⅓ of the total maximum firing rate and heat output of all the burners results in considerable inefficiencies, and more importantly in these days of energy conservation, in waste of fuel.

Summary of the Invention

In accordance with the present invention there is provided a control system for multiple burners or heaters utilized to heat the afterburner section of a scrap drying apparatus. The control system incorporating the present invention provides for cascade and sequential control of the heaters, including selective and sequential ignition and selective and sequential deenergization of burners when they are not needed for heating the afterburner section.

The selective energization and deenergization of heaters results in substantial savings in energy usage and a more efficient operation. For example, in a system having three heaters, the minimum heat output of the system using one burner having the typical minimum setting of ⅓ maximum, when the other two burners are turned off or deenergized, is approximately one-ninth of the maximum possible heat output of the system. This contrasts to systems in which all burners are required to be on at all times in which the maximum heat output would be only one-third of maximum. With more than three burners, the minimum heat output is a correspondingly lower fraction of the possible maximum, resulting in more efficient operations.

Thus, in accordance with the present invention, there is provided a control system for a plurality of fuel consuming heaters used in burner or heater systems. The control system of the present invention is suitable for use with single fuel or duel fuel systems, and automatically and selectively controls heater ignition and operation.

After manual ignition of any pilot flames, if the heaters require them, the system automatically controls and varies the output of a first burner between its low and high operating levels and automatically ignites and varies the operating level of additional burners, as necessary. The system automatically controls ignition of the additional burners, automatically interupts ignition once the pilot is ignited, deactivates or interrupts the pilot when the burner itself has been ignited, automatically relights the pilot immediately prior to extinguishing a burner, and provides for flame safety supervision.

Thus, in accordance with the present invention, after ignition of the pilot for each of the burners has been manually initiated, the first burner is operating at low value, and the system responds to decreases in temperature in the afterburner section for increasing the firing rate of the first burner. At the appropriate times the system of the present invention effects ignition of additional burners, and controls the firing rates of those burners in order to achieve the desired temperature level in the afterburner section.

Conversely, as the temperature level increases in the afterburner and the necessity for the external heating is reduced, the firing rate for each of the additional burners is reduced and finally when no longer needed the pilot is reignited and these burners are extinguished.

Thus, in accordance with the present invention, a temperature responsive burner control system is provided by which only the necessary burners are ignited and additional burners, when needed, are automatically and sequentially ignited in order to provide the necessary heat producing capacity. Numerous other advantages and features of the present invention will become readily apparent from the following detailed description of the invention and of one embodiment thereof, from the claims and from the accompanying drawing in which each and every detail shown is fully and completely disclosed as a part of this specification in which like numerals refer to like parts.

DESCRIPTION OF PREFERRED EMBODIMENT

Figures 1, 2:
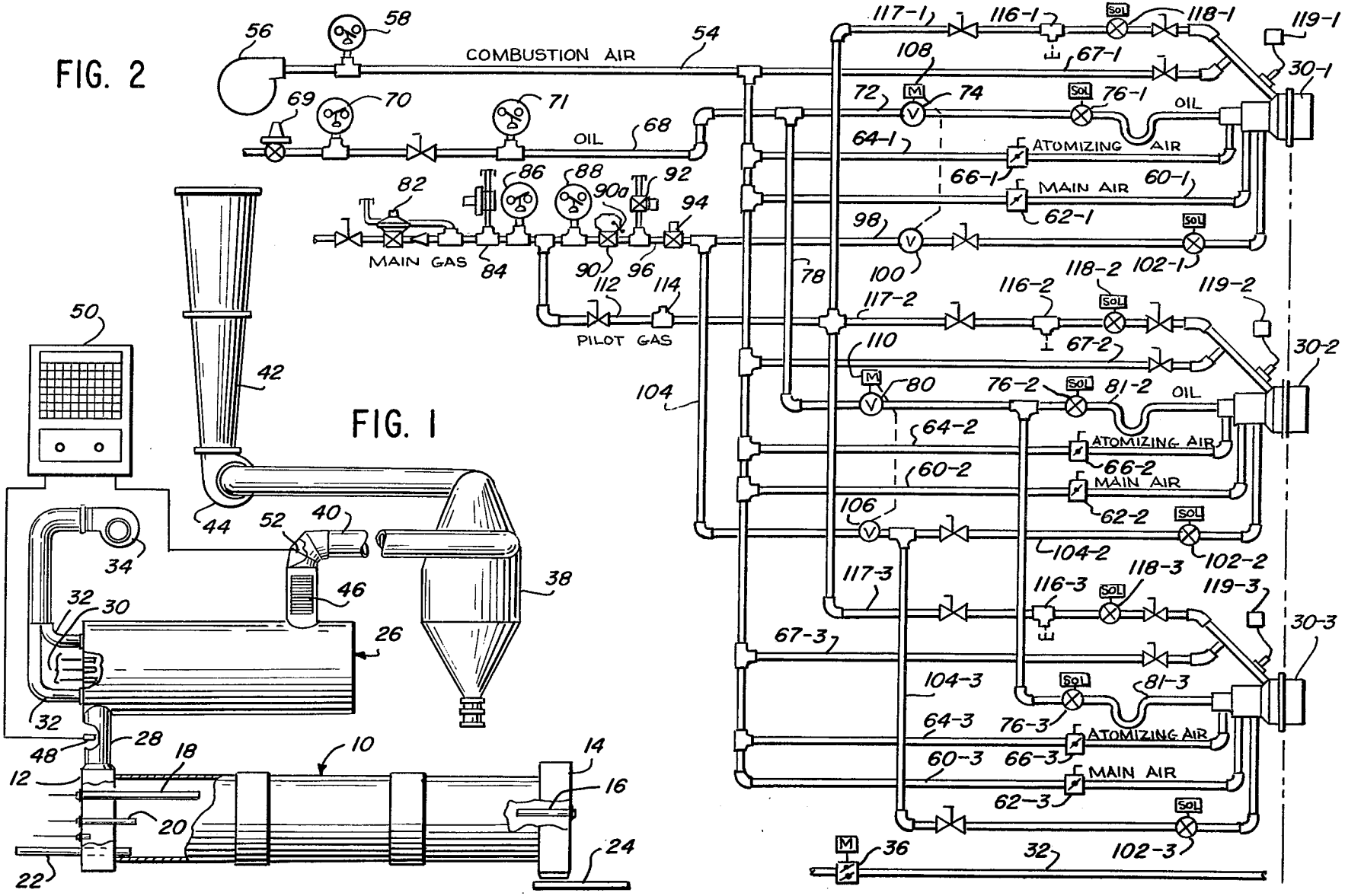
FIG. 1 is a generally diagrammatic elevational view partly broken away of a scrap drying system in which the present invention is embodied.
FIG. 2 is a schematic diagram of the combustion system for use with the present invention.

While this invention is susceptible of embodiment in many different forms, there is shown in the drawings and will herein be described in detail one specific embodiment, with the understanding that the present disclosure is to be considered as an exemplification of the principles of the invention and is not intended to limit the invention to the embodiment illustrated. The scope of the invention will be pointed out in the appended claims.

Referring to FIG. 1, there is shown a metal scrap drying system which includes a rotating drum dryer 10 having an input end 12 and an output end 14. The dryer 10 is provided with a preheat burner 16 located generally at the output end 14 and a main or primary burner 18 and an auxiliary burner 20 located at the input end 12.

Comminuted metal scrap is fed into the dryer 10 by a chip infeed conveyor 22 which introduces scrap into the input end 12 of the drum 10. Dried metal scrap is discharged at the output end 14 and carried away by the chip discharge conveyor 24.

An afterburner section 26 is disposed above the drum dryer 10 and is designed to receive hot exhaust gases from the drum dryer 10 through a dryer exhaust conduit 28. The exhaust gases typically contain at least some unburned combustible materials. The afterburner 26 is provided with a burner system 30 typically comprising a plurality of individual burners described in more detail below and also includes one or more secondary air inlets 32. A blower 34 supplies secondary air through the secondary air conduits or inlets 32 into the afterburner 26. Dampers 36 (FIG. 2) in the secondary air inlets control the amount of air introduced as a function of the temperature within the afterburner 26.

Exhaust gases from the afterburner 26 are fed into a dust collector 38 via an exhaust gas conduit 40. From the dust collector 38 the exhaust is directed to a stack 42 equipped with a stack blower 44. The draft in the afterburner is regulated by dampers 46 installed in the afterburner exhaust gas conduit 40.

Temperature within the dryer 10 is ascertained by sensing the temperature of the exhaust gases exiting from the drum into the afterburner 26. For this purpose, a thermocouple 48 is provided in the dryer exhaust conduit which is connected to a controller 50 which in turn controls the temperature within the drum dryer, for example, by controlling a nozzle bank as described in more detail in Larson U.S. Pat. No. 3,767,179.

In addition to controlling the temperature within the drum dryer itself, it is also necessary to control the temperature within the afterburner 26 to maintain a temperature high enough to insure complete combustion and yet not have any excess temperature which provides no useful purpose. Temperature within the afterburner 26 is sensed by a thermocouple 52 located in the exhaust conduit 40. The temperature is controlled in two ways. One way is to vary the amount of secondary air supplied to the afterburner 26 by operation of the modulating secondary damper 36 to insure that there is sufficient air within the afterburner 26 to allow for complete combustion and to supply additional secondary air when necessary to lower the temperature in the afterburner 26.

Primary temperature control is achieved, however, by selectively energizing and controlling the firing rate of each of the plurality of burners 30 making up the burner system located at the end of the afterburner 26 adjacent the afterburner inlet conduit 28. Typically, the burners 30 are either single fuel burners capable of burning either oil or gas or may be dual fuel units capable of alternatively burning either of these fuels. Typically, three or four burners 30 are utilized to achieve the desired temperature within the afterburner 26 when maximum heat is required.

When there is little or no unburned combustibles entering the afterburner 26, the burners 30 must be turned up sufficiently to maintain desired temperature. At other times, when there is sufficient quantities of unburned combustibles entering the afterburner 26, the combustion of these provides all the heat necessary to maintain the desired afterburner temperature. During these periods, it is desirable to supply as little heat as possible from the burners 30 in order to conserve fuel usage.

Turning to FIG. 2, there is shown a combustion schematic diagram for a system embodying a burner system 30 using three dual fuel burners 30-1, 30-2, 30-3. The dual fuel burners 30 are provided with the necessary combustion air through a combustion air line 54 connected to a combustion air blower 56. A low air pressure switch 58 in the combustion air line 54 precludes operation of the burners 30 in the absence of sufficient combustion air.

The combustion air supply is connected to each of the burners 30-1, 30-2, 30-3 through main burner air lines 60-1, 60-2, 60-3, respectively, through manual butterfly valves 62-1, 62-2, 62-3, to provide the necessary air flow for combustion of the oil or gas. In addition, the combustion air line 54 is also connected to atomizing air lines 64-1, 64-2, 64-3 through manually operated butterfly valves 66-1, 66-2, 66-3 to provide the necessary atomizing air flow when oil is utilized as the fuel, and to pilot air lines 67-1, 67-2, 67-3 for each of the burner pilot lights.

Oil is supplied to each of the burners 30 in parallel through a primary oil line 68 in which is located the main oil regulator 69, an oil high pressure switch 70, and an oil low pressure switch 71. The primary oil supply line 68 is connected directly to the oil supply line 72-1 for the primary or No. 1 burner 30-1 through a primary motorized fuel valve 74 and an oil solenoid valve 76-1. The main oil line 68 is connected to the No. 2 burner 30-3 and the No. 3 burner 30-3, the secondary burners, through a secondary oil line 78 and as secondary motorized oil fuel valve 80, and then to each of the burners 30-2 and 30-3 through corresponding oil solenoid valves 76-2, 76-3 located in individual burner lines 81-2, 81-3, respectively.

When gas is utilized as a fuel, it is applied from the gas supply through a main gas regulator 82, a gas venting valve 84, a gas high pressure switch 86, a gas low pressure switch 88, a gas safety shut off valve 90, a solenoid controlled main gas venting valve 92, and a solenoid controlled main gas blocking valve 94, all located in the main gas supply line 96. The gas line 98 for the primary burner 30-1, burner No. 1, is connected to the main gas supply line 96 through a primary motorized fuel valve 100 and a gas solenoid valve 102-1. Gas is supplied to the remaining two burners 30-2, 30-3, the secondary burners, through a secondary gas line 104, a secondary motorized fuel valve 106 and then to each of the burners 30-2, 30-3 through their respective solenoid gas valves 102-2, 102-3, in corresponding gas lines 104-2, 104-3. The primary motorized valves 74, 100 are driven by motor 108 and the secondary motorized valves 80, 106 are driven by motor 110.

A pilot gas line 112 is connected to the main gas line 96 between the high pressure and low pressure gas switches 86, 88 and includes a main pilot gas regulator 114 as well as pilot gas regulators 116-1, 116-2, 116-3 in each of the individual pilot gas lines 117-1, 117-2, 117-3 connected to the burners 30-1, 30-2, 30-3, respectively. Pilot gas solenoid valves 118-1, 118-2, 118-3 are also connected in each of the pilot gas lines 117-1, 117-2, 117-3.

In order to provide the necessary sensor safety, each of the burners 30 includes a flame sensor (not shown) operative to shut down fuel supply to the burner, as explained below, in the absence of a flame in the burner. In addition, an electrical ignition system 119-1, 119-2, 119-3 is provided for igniting each of the pilot lights in each of the burners 30, also as described in more detail below with respect to the control circuit disclosed in FIGS. 3*a* and 3*b*.

Figure 3A:
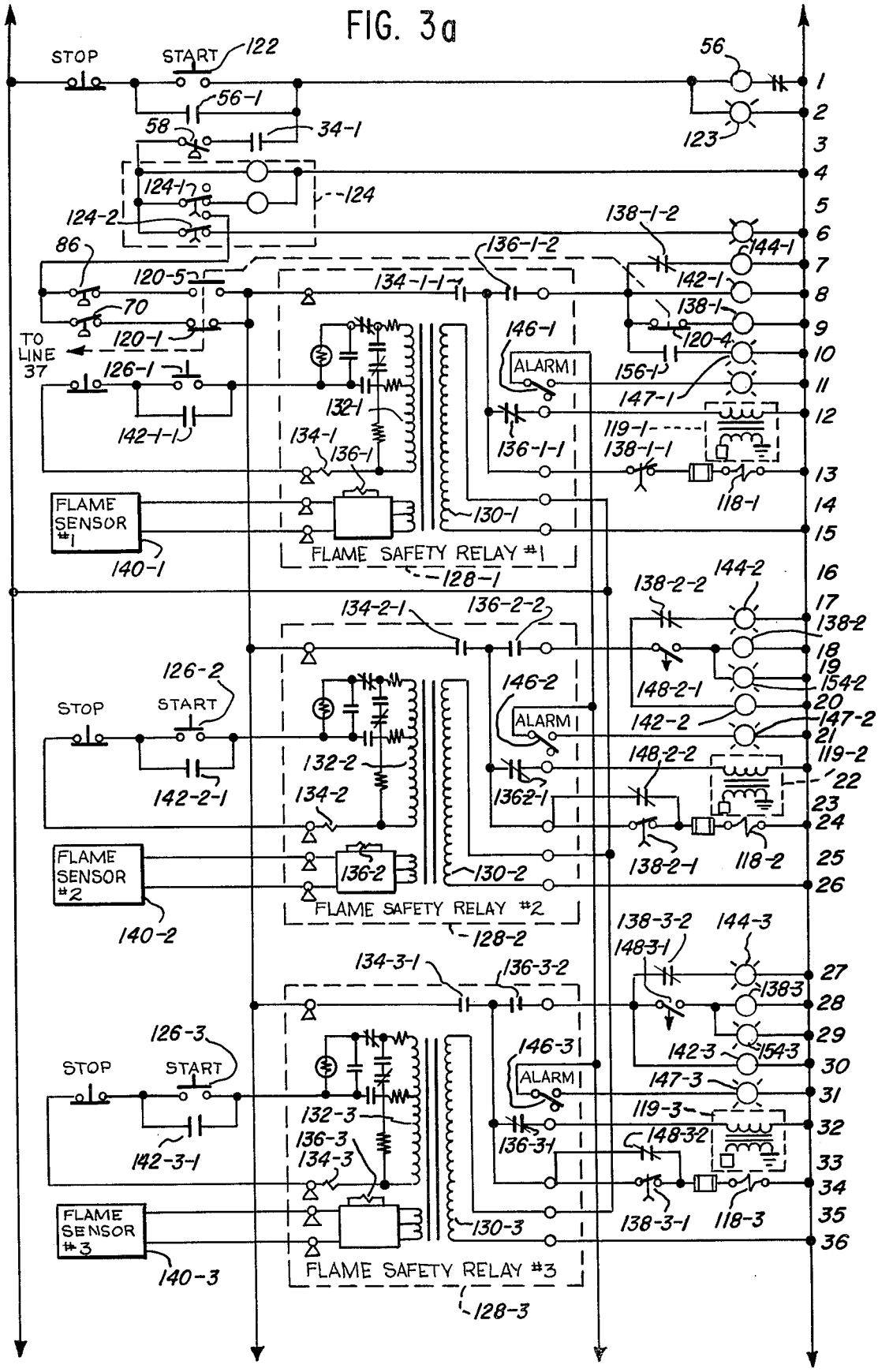
FIGS. 3*a* and 3*b* show a circuit diagram of the system of the present invention.
Figure 3B:
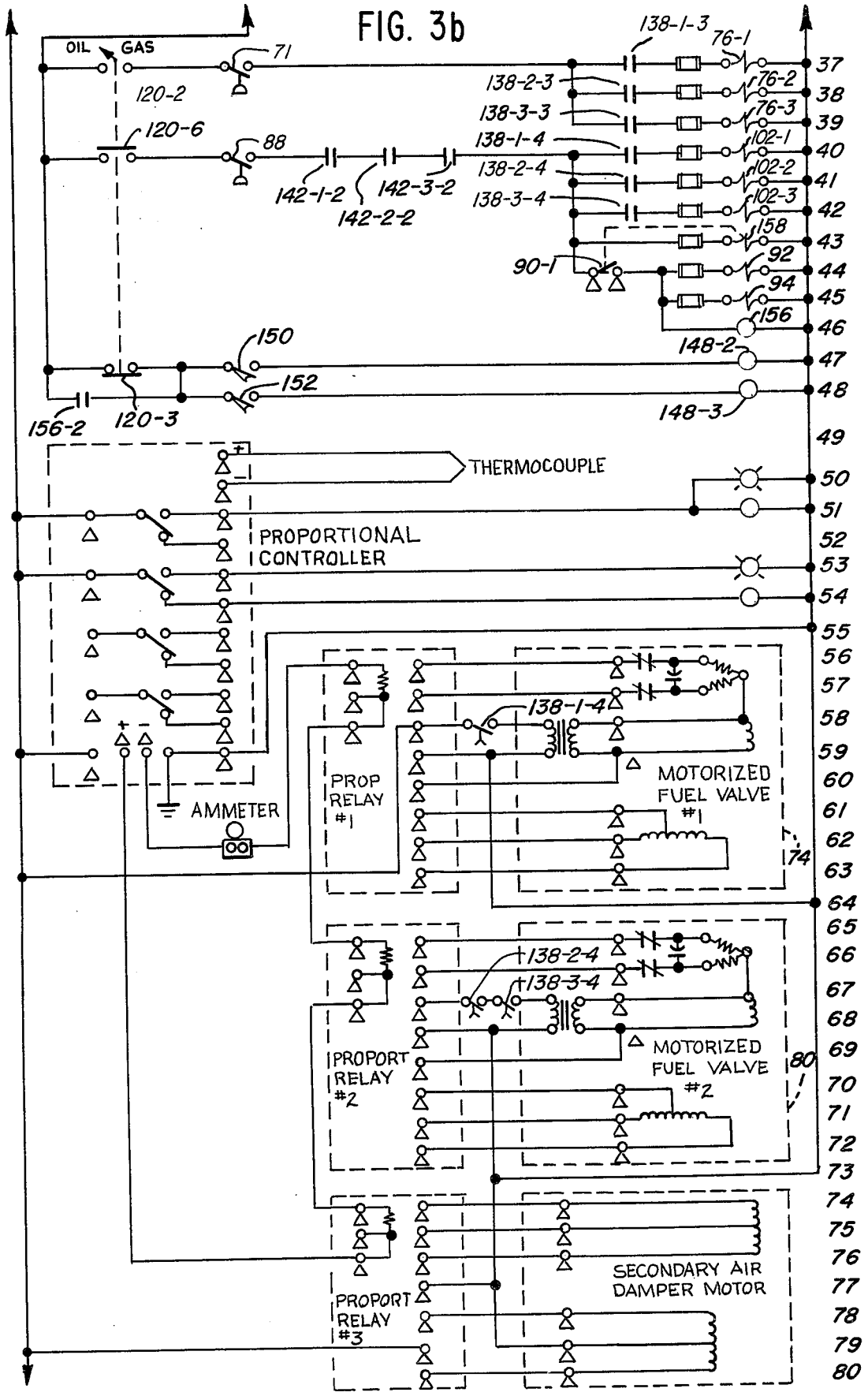

The control system of the present invention is shown in FIGS. 3*a* and 3*b*, and is capable of controlling burner operation whether used as gas burners or as oil burners. For ease of reference, like numbers are included in these figures of the drawings and are referred to below.

The control system is disclosed for use with dual fuel burners and includes a multi-contact, two position fuel selection switch 120 to select the fuel to be utilized. The fuel selection switch 120 includes oil selection contacts 120-1 (line 9), 120-2 (line 37), 120-3 (line 47) and 120-4 (line 9); and gas selection contacts 120-5 (line 8) and 120-6 (line 40). The fuel selection switch 120 is operated to select the desired fuel. In the position shown in the drawing, oil is the selected fuel, and the oil contacts 120-1, 120-2, 120-3, 120-4 are closed while gas contacts 120-5 and 120-6 are open. In its second position gas is the selected fuel, the oil contacts are open and the gas contacts are closed.

The system is energized by closing start switch 122 to turn on the combustion air blower 56 to provide air through the combustion air line 54, main air lines 60, atomizing air lines 64, and pilot air lines 67 as necessary to support combustion. When combustion air blower 56 is energized, indicator light 123 (line 2) turns on, and a pair of contacts 56-1 (line 2) bypassing the start switch 122 are closed to allow the system to continue to operate after the start switch 122 is released.

If the secondary air blower 34 is on, interlock contacts 34-1 (line 3) are closed to energize a purge timer 124 (lines 4–6), which is energized if combustion air in air line 54 is up to pressure, and the combustion air low pressure switch 58 (line 3) is closed. When the purge timer 124 times out, a pair of normally closed delay contacts 124-1, 124-2 are operated to deenergize the timer 124 and a purge timer indicator light 126 (line 6), and to enable the balance of the combustion control circuit.

For purposes of illustration, the control system of the present invention has been illustrated in connection with dual fuel burners. Therefore, before igniting any of the burners 30, it is necessary to operate the fuel selection switch 120, as described above, to enable the various circuit components, either for use of oil, or for use of gas. If oil is to be the fuel used, the switch is in the position illustrated in the drawing so that when the oil high pressure switch 70 (line 9) closes, indicating that oil pressure is not too high, the circuit is enabled through the closed contacts 120-1 of fuel selection switch 120.

Each of the burners 30-1, 30-2, 30-3, is ignited by actuation of manually operated normally open burner start switch 126-1 (line 11), 126-2 (line 21), and 126-3 (line 31), respectively. Thus, for primary burner 30-1, when switch 126-1 is closed, a flame safety relay circuit 128-1 is energized. In the illustrated embodiment, this relay circuit is a Honeywell Model No. RA890G, in which the primary 130-1 is normally energized. Closure of the burner start switch 126-1 completes a circuit through the secondary 132-1 to energize the relay.

After a warm up delay, a load relay 134-1 closes its normally open load relay contacts 134-1-1 (line 8) in series with the oil high pressure switch 70 and the fuel selection switch contacts 120-1. When the load relay contacts 134-1-1 are closed, a circuit is completed through the normally closed contacts 136-1-1 (line 12) of a flame relay 136-1 (line 14) to energize the ignition system 119-1 (line 12). A circuit is also completed through the normally closed contacts 138-1-1 (line 13) of a timing control relay 138-1 (line 9) to energize the pilot gas solenoid 118-1 (line 13).

When the start switch 126-1 (line 11) is closed, a flame sensing circuit 140-1 (lines 14–15), such as a Honeywell model No. C7027A, is also energized. When a pilot flame is detected by a flame sensor 140-1, the flame relay 136-1 (line 14) is energized to open the normally closed contacts 136-1-1 (line 12), thereby deenergizing the ignition system 119-1; and to close normally open contacts 136-1-2 (line 8) to energize the timing control relay 138-1 (line 9) through the closed oil contacts 120-4 of the fuel selection switch, and a burner relay 142-1 (line 8). The energized burner relay 142-1 closes normally open contacts 142-1-1 (line 12) across the start switch 126-1 so that the start switch may be released.

Simultaneously, a timing indicator light 144-1 (line 7) is energized through normally closed contacts 138-1-2

(line 7) of the timing relay 138-1 (line 9). When the timing relay 138-1 is energized, the normally open timing contacts 138-1-3 (line 37) in series with the main fuel oil solenoid 76-1 (line 37) are closed to energize fuel oil solenoid 76-1 if there is at least a minimum oil pressure resulting in closure of the oil low pressure switch 71 (line 37) connected in series with the solenoid 76-1 and the contacts 120-2 of the fuel selection switch.

When the timing relay 138-1 times out, the normally closed delay contacts 138-1-1 (line 13) in series with the pilot gas solenoid 118-1 are opened to deenergize the solenoid 118-1 and shut off the pilot gas supply, since the fuel oil now supplied to the burner 30-1 as a result of the fuel oil solenoid 76-1 having been energized should have been ignited. If at any time a flame is not detected by the flame sensor, e.g., if the pilot light or the fuel oil has not been ignited, the flame sensor 140-1 automatically shuts down all fuel supply to the burner and closes alarm contacts 146-1 to energize an alarm circuit (not shown) and indicator 147-1.

When the timing relay 138-1 times out, the normally open contacts 138-1-4 (line 58) in series with the motor 108 for the primary motorized fuel valve 74 are closed to enable that valve motor which opens and closes in response to temperature variations in the afterburner 26. Thus, when the first burner is turned on, the motorized fuel valve 74 is automatically opened to its minimum value and the primary burner 30-1 continually operates at the low setting.

The pilot for the second burner 30-2 is also ignited in a manner similar to that described above, by actuation of the second burner start switch 126-2 (line 21). As in the case of the first burner 30-1, the flame safety relay circuit 128-2 is thereby energized to energize the second burner load relay 134-2 (line 24). The load relay contacts 134-2-1 (line 18) are thus closed. When the load relay contacts 134-2-1 are closed, the second burner ignition system 119-2 (line 22) is energized through the normally closed contacts 136-2-1 (line 22) of the flame relay 136-2.

The pilot gas solenoid 118-2 (line 24) is also energized open through the normally closed contacts 138-2-1 (line 24) of the second burner timing relay 138-2, (line 18) or the normally closed contacts 148-2-2 (line 23) of a secondary burner start relay 148-2 (line 47).

When the flame relay 136-2 is energized, the pilot indicator light 144-2 (line 17) is energized through the normally closed contacts 138-2-2 (line 17) of the timing relay 138-2 (line 18); and the burner control relay 142-2 (line 20) is energized to close the normally open contacts 142-2-1 (line 22) across the start switch 126-2 to allow that switch to be released.

The second burner fuel oil solenoid 76-2 (line 38) is not energized at this time since the timing relay 138-2 (line 18) is not energized. Timing relay 138-2 is connected in series with the normally open timed contacts 148-2-1 (line 18) of secondary burner start relay 148-2 (line 47), which in turn is connected in series with the normally open contacts of a first motorized fuel valve limit switch 150 (line 47) the operation of which will be described below.

The pilot light for the third burner 30-3 is ignited in a fashion substantially the same as is the pilot light for the second burner 30-2. When the manually operated start switch 126-3 (line 31) is closed, the third burner flame safety relay circuit 128-3 is energized. The load relay 134-3 (line 34) is thus energized to close its normally open contacts 134-3-1 (line 28) thereby energizing the ignition system 119-3 (line 32) through the normally closed contacts 136-3-1 (line 32) of the flame relay 136-3 (line 35).

At the same time the pilot gas solenoid 118-3 (line 34) is energized through the normally closed contacts 138-3-1 (line 34) of the timing control relay 138-3 (line 28) or the normally closed contact 148-3-2 (line 33) of the third burner start relay 148-3 (line 48). When the pilot light is ignited, the flame sensor 140-3 detects the presence of a flame to energize the flame relay 136-3 (line 35) which closes the normally open contacts 136-3-2 (line 28) connected to the pilot indicator light 144-3 (line 27) through the normally closed contacts 138-3-2 (line 27) of the timing relay 138-3 and enables a circuit to the timing relay 138-3 which is not energized because of the normally open contacts 148-3-1 of the start relay 148-3. The burner relay 142-3 (line 30) is energized to close the normally open contacts 142-3-1 across the start switch 126-3 to allow that switch to be released.

Thus, after the start sequence for the three burners, the first burner 30-1 is operating at the low setting, and the pilot lights of the remaining burners 30-2, 30-3 have been ignited to enable those burners to ignite when they are needed to supply additional heat.

As indicated above, the motorized fuel valve 74 regulates the fuel flow, in this case oil flow, to burner No. 1. This valve is operated to supply more fuel oil as more heat is required. The motorized fuel valve, a Honeywell Modutrol Model M945C, also includes a pair of internal, cam-actuated limits switches 150 (line 47), 152 (line 48). These limit switches, as indicated above, are connected in series with the start relays 148-2, 148-3 for the second and third burners, 30-2, 30-3 respectively, and are utilized to initiate start up and shut down of those burners.

For example, as heat requirements in the afterburner 26 increase, resulting in the motorized fuel valve supplying more fuel, the first of the limit switches 150 closes when the motorized fuel valve reaches a preselected setting. In one embodiment of the system of the present invention, the first limit switch 150 is closed when the first motorized fuel valve reaches a setting of approximately 50% of the maximum temperature or high fire position.

When the first limit switch 150 closes, the start control relay 148-2 (line 47) for the second burner 30-2 is energized. The energized second burner start relay 148-2 opens the normally closed contacts 148-2-2 (line 23) in series with the pilot light solenoid 118-2 (line 24), but the solenoid 118-2 is not deenergized because of the normally closed contacts 138-2-1 of the timing relay 138-2, which has not been energized, remain closed. The timed contacts 148-2-1 (line 18) of the start relay 148-2 connected in series with the timing delay 138-2 then close to energize the timing relay and the timing light 154-2. The normally closed contacts 138-2-2 (line 17) of the timing relay 138-2 are opened to turn off the pilot light indicator 144-2, and the normally open contacts 138-2-3 (line 38) in series with the oil fuel solenoid 76-2 close to energize and open the solenoid valve to effect supply of the fuel to the No. 2 burner 30-2.

After a delay sufficient to allow the oil being supplied to the burner to be ignited by the pilot, the delayed normally closed contacts 138-2-1 (line 24) in series with the pilot gas solenoid 118-2 open to deenergize and close that solenoid valve and extinguish the pilot light.

When the first motorized fuel valve 74 reaches its high fire position, i.e., the system continues to require additional heat in spite of the fact that the second burner is operating at ⅓ of high fire, i.e., the low fire position, a second limit switch 152 in series with the third burner start relay 148-3 (line 48) closes to energize that relay. As in the case of the second burner, the normally open contacts 148-3-2 in series with the pilot gas solenoid 118-3 open, but this solenoid is not extinguished because of the closed contacts 138-3-1 of the third burner timing relay 138-3.

After a delay, the normally open contacts 148-3-1 (line 28) of the start relay 148-3 in series with the timing relay 138-3 close to energize the timing relay and the burner on indicator 154-3. When the timing relay 138-3 is energized, the normally closed contacts 138-3-2 in series with the pilot indicator 144-3 (line 27) open to turn that light off, and the normally open contacts 138-3-3 (line 39) in series with the oil fuel solenoid 76-3 close to supply fuel oil to the third burner 30-3.

After a delay sufficient to effect ignition of the fuel oil, the normally closed delay contacts 138-3-1 (line 34) in series with the pilot gas solenoid 118-3 open to extinguish the pilot light for the third burner 30-3, since the fuel being supplied to that burner has been ignited.

In both cases, the flame sensors 140-2 and 140-3 sense whether a flame is in existence and in the absence of a flame shut off all fuel to the burner by deenergizing the flame relay 136 and energizing the alarm circuit 146 (lines 21, 31). The timing relays 138-2, 138-3 for the second and third burners 30-2, 30-3, also have normally open contacts 138-2-4, 138-3-4 (line 67) in series with the second motorized fuel valve which when both closed energize that valve and allow it to operate in response to temperature conditions within the afterburner 26.

As the heat demands diminish within the afterburner 26, the second motorized fuel valve 80 returns to its minimum position. The first motorized fuel valve 74 also tends to close. When the first motorized fuel valve reaches approximately 50% of its high fire position, the limit switch 152 (line 48) in series with the third burner start control relay 148-3 opens to deenergize that relay. When the start relay 148-3 is deenergized, the normally open contacts 148-3-2 (line 33) in series with the pilot gas solenoid 118-3 (line 34) close to energize that solenoid, opening the pilot gas solenoid valve to effect ignition of the pilot light from the fuel being burned in the burner.

Thereafter, the delay contacts 148-3-1 (line 28) of the start valve open to deenergize the third burner timing relay 138-3 allowing normally open contacts 138-3-3 (line 39) in series with the fuel oil solenoid valve 76-3 to open, thereby closing that valve and shutting off the fuel supply to the third burner 30-3. At the same time, the contacts 138-3-2 (line 27) in series with the pilot light indicator 144-3 close to turn on that light and indicate that the third burner pilot light is on.

When the first motorized fuel valve 74 reaches its low fire position, the contacts 150 (line 47) in series with the second burner control start relay 148-2 open to deenergize that relay closing the normally closed contacts 148-2-2 in series with the second burner pilot gas solenoid 118-2 to ignite the pilot light from the burning fuel oil. Thereafter, the delay contacts 148-2-1 (line 18) of the start valve in series with the timing relay 138-2 open to deenergize that relay and turn off the burner light 154-2. The timing relay 138-2 when deenergized allows its normally closed contacts 138-2-2 (line 17) in series with the pilot light indicator 144-2 to close thereby energizing that light and opens the contacts 138-2-3 (line 38) in series with the fuel oil solenoid 76-2 to shut off the fuel supply to the second burner 30-2. The normally closed delay contacts 138-2-1 (line 24) in series with the pilot gas solenoid 118-2 also close but have no effect in view of the fact that the start solenoid contacts 148-2-2 in parallel therewith have already closed.

The operation in the gas mode is substantially the same as described above except that by operation of the fuel selection switch, oil contacts 120-1 (line 9), 120-2 (line 37) 120-3 (line 47) and 120-4 (line 9) are opened and gas contacts 120-5 (line 8) and 120-6 (line 40) are closed. In this mode the gas high pressure switch 86 (line 8) is connected in series with the fuel selection switch contacts 120-5. In addition, since contacts 120-4 of the fuel selection switch in series with the first burner timing relay 138-1 are open, that relay can be energized only when the normally open contacts 156-1 (line 10) of a safety relay 156 (line 46) in series with timing relay 138-1 are closed. The operation of relay 156 is described below.

In the gas mode, when the start switch 126-1 for the first burner 30-1 is closed, the first load relay 134-1 is energized as before to close contacts 134-1-1 and complete the circuit through the ignition circuit 119-1 and the normally closed contacts 138-1-1 of the flame relay 138-1. At the same time, the pilot gas solenoid 118-1 is also energized through the normally closed delay contacts 138-1-1 of the timing relay 138-1 to supply pilot gas to the pilot light to permit ignition.

When the flame relay 136-1 is energized, the normally open contacts 136-1-2 in series with the burner relay 142-1 close so that the normally open contacts 142-1-1 across the start switch 126-1 also close allowing the start switch to be released. This is indicated by the pilot light indicator 144-1 being turned on through the normally closed contacts 138-1-2 of the timing relay 138-1. The second and third burner pilot lights are similarly ignited as described above.

Each of the burner relays 142-1, 142-2, 142-3 also includes normally open contacts 142-1-2, 142-2-2, 142-3-2 in series with the gas low pressure switch 88 (line 40) so that once the three burner pilot lights have been ignited and the low pressure switch 88 closes, i.e., the gas pressure is up to minimum, the gas safety valve solenoid 158 (line 43) is energized. This allows the safety shut off valve 90 (FIG. 2) to be opened manually by operation of a hand lever 90*a*. When the safety shut off valve 90 is open, a limit switch 90-1 (line 44), in series with the main gas blocking valve solenoid 94 and venting valve solenoid 92 is closed to energize and open those valves.

The limit switch 90-1 is also in series with the gas safety valve relay 156 which is also energized. The normally open contacts 156-1 (line 10) of the gas safety relay 156 thus close to energize the first burner timing relay 138-1, thereby closing contacts 138-1-4 to energize the gas solenoid 102-1 for the first burner 30-1 to supply gas to the burner to be ignited by the pilot light. When the timing relay 138-1 is energized, the operation of the system is the same as above except that the normally open contacts 138-1-4, 138-2-4, 138-3-4 of each of the timing relays 138-1, 138-2, 138-3 are in series with each of the gas solenoid valves 102-1, 102-2, 102-3, respectively.

Thus, there has been disclosed a burner control system for use with a plurality of burners which provides for controlled ignition of the pilot light for each burner, for the controlled ignition of the primary burner for use with either of two fuel systems, and for controlled supplemental ignition of the secondary burners when those burners are required to supply additional heat to the system being heated. The control system of the present invention provides for low fire start, for interruption of the ignition system when not needed, for interruption of the pilot light when not needed, i.e., when the burners are in operation, for automatic pilot reignition, for automatic extinguishing of the supplemental burners when their heat generating capacity is not needed to be used, and for complete flame safety supervision.

The control system of the present invention provides the desired operational control of a plurality of burners while simultaneously providing a wider range of heat generating capacity and fuel conservation when the supplemental burner capacity is not required.

The system in accordance with the present invention thus provides highly efficient operation, lower fuel consumption and a wider range of burner operation to provide a wider range of heat generating capacity, particularly at the low heat end while providing for automatic operation and safety.

From the foregoing, it will be observed that numerous variations and modifications may be effected without departing from the true spirit and scope of the novel concept of the invention. It is, of course, intended to cover by the appended claims all such modifications as fall within the scope of the claims.

I claim:

1. In a system for treating metal scrap contaminated with combustible substances including a dryer for heating the scrap to effect removal of the contaminants and combustion thereof, and an afterburner for effecting complete combustion of said contaminants, a system for controlling the temperature of the afterburner to insure complete combustion comprising:

a plurality of controllable heaters disposed in said afterburner and individually selectively operable to heat said afterburner to maintain a selected temperature therein;

means for sensing the temperature in said afterburner and for producing a sensing signal representative thereof; and control circuit means responsive to said temperature sensing signal for individually selectively energizing and controlling the heat output of said heaters to maintain said selected temperature, said control circuit means including:

fuel supply valve means responsive to said temperature sensing signal for varying the supply of fuel to a first one of said heaters to vary the heat output thereof between minimum and maximum levels to maintain said selected afterburner temperature and, heater control means for controlling additional ones of said heaters by individually selectively energizing and deenergizing said additional heaters in response to first and second preselected amounts of fuel being delivered to said first one of said heaters and by individually selectively varying the heat output of said additional heaters between minimum and maximum levels in response to said temperature sensing signal, and to individually selectively deenergize said additional heaters all to maintain said selected afterburner temperature, whereby the energy utilized by said heating system to maintain said selected afterburner temperature is minimized.

2. In the system as defined in claim 1:

said heater control means energizing a second one of said heaters in response to the first preselected amount of fuel having a value approximately equal to one-half the maximum amount of fuel capable of being delivered and deenergizing said second one of said heaters in response to the second preselected amount of fuel having a value approximately equal to one-third the maximum amount of fuel capable of being delivered.

3. In the system as defined in claim 1:

said heater control means energizing a third one of said heaters in response to the first preselected amount of fuel having a value approximately equal to the maximum amount of fuel level capable of being delivered and deenergizing said third one of said heaters in response to the second preselected amount of fuel having a value approximately equal to one-half the maximum amount of fuel capable of being delivered.

4. In the system as claimed in claim 1 wherein the control circuit means further includes pilot light ignition means associated with each heater for igniting a pilot flame in said associated heater in response to deenergization of said associated heater.

5. In the system as claimed in claim 4 wherein the control circuit means further includes pilot light extinguish means associated with each heater for extinguishing said pilot flame in said associated heater in response to energization of said associated heater.

* * * * *

UNITED STATES PATENT OFFICE

CERTIFICATE OF CORRECTION

Patent No. 4,252,300 Dated 24 February 1981

Inventor(s) Gary A. Herder

It is certified that error appears in the above-identified patent and that said Letters Patent are hereby corrected as shown below:

Col. 1, line 19, "wording" should be -- working --.

Col. 2, line 56, "interupts" should be -- interrupts --.

Col. 5, line 9, "30-3" (first occurrence) should be -- 30-2 --.

Col. 8, line 31, "limits" should be -- limit --.

Col. 8, line 55, "delay" should be -- relay --.

Signed and Sealed this

*Eighth* Day of *September 1981*

[SEAL]

*Attest:*

GERALD J. MOSSINGHOFF

*Attesting Officer*

*Commissioner of Patents and Trademarks*